US006554271B1

(12) United States Patent
Lindsay et al.

(10) Patent No.: US 6,554,271 B1
(45) Date of Patent: Apr. 29, 2003

(54) PAPER FOLDING MACHINE WITH FEEDER

(75) Inventors: Timothy D. Lindsay, Dover, NH (US); Chad Bones, Modesto, CA (US)

(73) Assignee: Bescorp, Inc., Dover, NH (US)

( * ) Notice: Subject to any disclaimer, the term of this patent is extended or adjusted under 35 U.S.C. 154(b) by 67 days.

(21) Appl. No.: 09/604,701

(22) Filed: Jun. 28, 2000

(51) Int. Cl.[7] ..... B65H 3/52
(52) U.S. Cl. ..... 271/121; 271/124
(58) Field of Search ..... 271/121, 124, 271/241, 147, 160

(56) References Cited

U.S. PATENT DOCUMENTS 4,394,009 A * 7/1983 Bergman et al.
4,552,353 A 11/1985 Tanaka et al.
4,588,181 A 5/1986 Sakata et al.
4,896,871 A 1/1990 Idenawa
4,991,830 A 2/1991 Yamanaka
5,246,221 A * 9/1993 Sugimoto et al.
6,145,831 A * 11/2000 Inoue et al. ..... 271/121

* cited by examiner

*Primary Examiner*—David H. Bollinger
(74) *Attorney, Agent, or Firm*—Donald Cayen

(57) ABSTRACT

An inexpensive paper folding machine includes a paper feeder that reliably propels sheets one at a time in a downstream direction. The feeder includes a paper supply station that biases a stack of sheets against a pickoff wheel. The pickoff wheel propels the topmost sheet to a gate tip. The gate tip is comprised of a singulator that is biased against the pickoff wheel. A clearance is set between a singulator screw and the singulator. The clearance is greater than the sheet thickness, but less than two times the sheet thickness. As a sheet is propelled by the pickoff wheel from the paper supply station, the sheet leading edge enters the nip between the pickoff wheel and the singulator. The singulator pivots to take up part of the clearance. If a second sheet is propelled with the topmost sheet, the second sheet cannot pass between the nip. The paper folding machine further comprises a skew compensator that compensates for sheets that are misoriented relative to the downstream direction. In a modified embodiment, a relatively soft pickoff wheel is used, and the clearance is less than the thickness of a sheet. The pickoff wheel is compressed as the sheet passes through the nip between the singulator and the pickoff wheel.

22 Claims, 6 Drawing Sheets

PAPER FOLDING MACHINE WITH FEEDER

BACKGROUND OF THE INVENTION

This invention pertains to processing paper sheets, and more particularly to apparatus that feeds and folds individual sheets of paper.

DESCRIPTION OF THE PRIOR ART

Various types of equipment have been developed that feed paper sheets to mechanisms that process the sheets in a variety of ways. For example, photocopy machines invariably include feeders that supply paper sheets to the mechanisms that produce images on the sheets.

A particularly important application of paper feeders pertains to folding and sealing machines. My U.S. Pat. No. 6,264,592 describes an exemplary combination folding and sealing machine that includes a paper feeder.

It is critical in a folding machine that the paper sheets be consistently and properly fed to the folding mechanisms. For successful and economical operation, the feeder must deliver the sheets at high speed, one at a time, and properly oriented. The feeder must not allow a subsequent sheet to be propelled downstream until the previous sheet has completely left the feeder. If more than one sheet is propelled downstream at the same time, jams will occur at a downstream station. At the same time, all the sheets must be oriented such that their side edges are parallel to the direction of downstream travel. Failure to properly orient the sheets results in unacceptable misalignments in the folded sheets.

Prior equipment exists that successfully feeds paper sheets. However, the prior equipment is both complicated and expensive. For instance, one prior feeder used a solenoid that coacted with a feed wheel to propel the sheets downstream. On the other hand, there has been a long standing need for a dependable feeder for use with low cost folding and sealing machines. The advantages obtained from developing low cost folding and sealing machines is lost if the feeder is disproportionately expensive relative to the folding and sealing mechanisms.

Prior feeders suffered the further disadvantage of being able to accommodate only a single thickness of paper without adjustment. For example, U.S. Pat. Nos. 4,552,353 and 4,588,181 show sheet feeding apparatus that limits a gap between a feed roller and a pivotal friction member to a spacing corresponding to a single sheet. The U.S. Pat. Nos. 4,552,353 and 4,588,181 patents show automatic adjusting devices for maintaining a single clearance between a feed wheel and a friction member. The expense, as well as the potential unreliability, of attempting to use only a clearance equal to the thickness of one sheet makes the foregoing adjustment devices of questionable usefulness on low cost paper processing machines. A related problem was that it was awkward to adjust the prior paper feeders to accommodate different sheet thicknesses. Prior low cost paper feeders were also limited in the number of sheets that could be stacked on them.

Other paper feeders are shown in U.S. Pat. Nos. 4,896,871 and 4,991,830. Neither is suitable for reliable low cost feeding.

SUMMARY OF THE INVENTION

In accordance with the present invention, a paper folding machine includes a simple and low cost feeder that reliably propels one sheet of properly oriented paper at a time in a downstream direction. This is accomplished by apparatus that includes a gate tip that conveniently adjusts to accommodate a range of sheet thicknesses.

The paper sheets are propelled from a stack loaded at a paper supply station upstream of the gate tip. An upstream end of a tray of the paper supply station is supported for swinging on the machine frame by means of a tray shaft. The sheets are stacked on the tray such that their leading edges are under a pickoff wheel. A tray spring biases the topmost sheet of the stack into contact with the pickoff wheel at a first tangent point. Rotation of the pickoff wheel propels the topmost sheet by friction in the downstream direction to the gate tip.

The gate tip also underlies the pickoff wheel. The gate tip comprises a singulator that is pivotally connected to a ramp that in turn is attached to the frame. A singulator spring is interposed between the ramp and the singulator. The singulator spring biases the singulator to contact the pickoff wheel at a second tangent point. To limit the pivotal motion of the singulator away from the pickoff wheel, a singulator screw is threaded into the ramp. The end of the singulator screw shank is set at a selected clearance from the singulator. To provide high resolution when setting the clearance, the singulator screw longitudinal centerline does not pass through the axis of rotation of the pickoff wheel. Instead, the singulator screw longitudinal centerline is downstream of the pickoff wheel axis of rotation. The singulator can be pivoted in the second direction against the force of the singulator spring. The singulator screw is adjusted such that the clearance with the singulator is at least equal to the thickness of one of the particular paper sheets being processed, but the clearance is less than the thickness of two sheets. In some applications, a relatively soft pickoff wheel is used. In those instances, the singulator screw is adjusted such that its clearance with the singulator is slightly less than the thickness of a sheet.

The leading edge of a topmost paper sheet that is propelled by the pickoff wheel from the stack on the tray strikes the singulator slightly upstream of the second tangent point of the pickoff wheel with the singulator. Should a second sheet be propelled from the stack to the gate tip along with the topmost sheet, the second sheet cannot pass through the nip between the pickoff wheel and the singulator. That is because the clearance between the singulator screw and the singulator is less than the thickness of the two sheets. The leading edge of the second sheet will merely remain in place between the topmost sheet and the singulator until the topmost sheet trailing edge has passed completely through the nip. At that point, the clearance between the singulator screw and the singulator allows the second sheet leading edge to enter the nip and be propelled downstream.

When a relatively soft pickoff wheel is used and the clearance between the singulator screw and the singulator is less than the paper sheet thickness, the pickoff wheel compresses as a topmost sheet passes through the nip between the singulator and the pickoff wheel. The compression of the pickoff wheel is sufficient to enable the topmost sheet to be propelled through the nip. However, the pickoff wheel does not compress enough for a second sheet to pass through the nip with the topmost sheet. The second sheet remains in place between the topmost sheet and the singulator until the topmost sheet has passed completely through the nip.

The gate tip of the invention is capable of accommodating relatively wide variations of paper thickness without adjustment. For a selected clearance between the singulator and the singulator screw that suits a first sheet thickness, sheets of greater thickness up to slightly less than double the first thickness can be handled without adjustment. On the other hand, when adjustment is necessary for the clearance, the singulator screw is easily accessible for quick and easy adjustment.

The present invention is also concerned with proper feeding of the paper sheets regardless of the number of sheets loaded at the paper supply station. Loading a stack of sheets on the tray causes the tray downstream end to swing downwardly in an arc through a tray swing angle about a tray shaft against the force of the tray spring. The plane of the topmost sheet in the stack therefore makes an angle in space that depends on the number of sheets in the stack. The first tangent point of contact between the topmost sheet and the pickoff wheel changes as the number of sheets changes. As a result, the angle about the pickoff wheel axis of rotation subtended by the first and second tangent points also varies. Another consequence of the variable location of the first tangent point is that the leading edge of a sheet strikes the singulator at an angle that is dependent on the number of sheets loaded on the tray. The gate tip of the invention successfully allows for the variation in the various geometric relations among the sheets, pickoff wheel, and singulator caused by loading different quantities of paper at the paper supply station.

Further in accordance with the present invention, the paper feeder propels the sheets in the downstream direction in a perfectly oriented manner. That is, the side edges of the sheets are parallel to the downstream direction of the sheets. To obtain proper sheet orientation, the paper folding machine includes a skew compensator. The skew compensator comprises a pivot bracket mounted to the tray shaft. The upstream end of the tray rests on the pivot bracket. The tray is connected to the bracket for rotating about a bracket axis that is generally perpendicular to the downstream direction. A side bracket is also fixed to the tray shaft. A compensator screw passing through the side bracket mates with threads in the tray. Turning the compensator screw causes the tray to rotate about the bracket axis. In that manner, the tray can be rotated to properly orient the sheets for downstream feeding.

As mentioned, the tray downstream end swings downwardly in an arc about a tray shaft against the force of the tray spring when a stack of papers is loaded on the tray. To prevent the stack from sliding off the tray downstream end, as well as to keep the leading edges of the sheets in alignment, the paper feeder includes a plate adjacent the tray downstream end. The plate is generally tangent to the arc through which the tray downstream end swings. In a preferred embodiment, the plate is part of the ramp to which the singulator is connected. The ramp plate and the downstream end of the tray cooperate such that a stack of sheets need not be fanned before it is loaded on the tray.

It is a further feature of the invention that the paper feeder is easily integrated into the paper folding machine. In fact, the feeder is ideal as an integral part of a low cost folding machine. The paper sheets propelled downstream by the feeder are folded and discharged as completed forms at the downstream end of the machine. The completed forms are propelled by belts on which the forms ride. An important aspect of the invention is that the conveyor belts do not wander laterally during operation. To prevent belt wander, the belt drive shaft is grooved. The shaft grooves receive the belts and guide them laterally. To provide additional belt guidance, the shaft grooves are crowned.

The method and apparatus of the invention, using an easily adjustable gate tip and a skew compensator, thus reliably supplies sheets one at a time to paper processing equipment. The probability of misfeeding or misfolding a sheet is remote, even though the paper feeder is inexpensive to manufacture and convenient to operate.

DETAILED DESCRIPTION OF THE INVENTION

Figure 1:
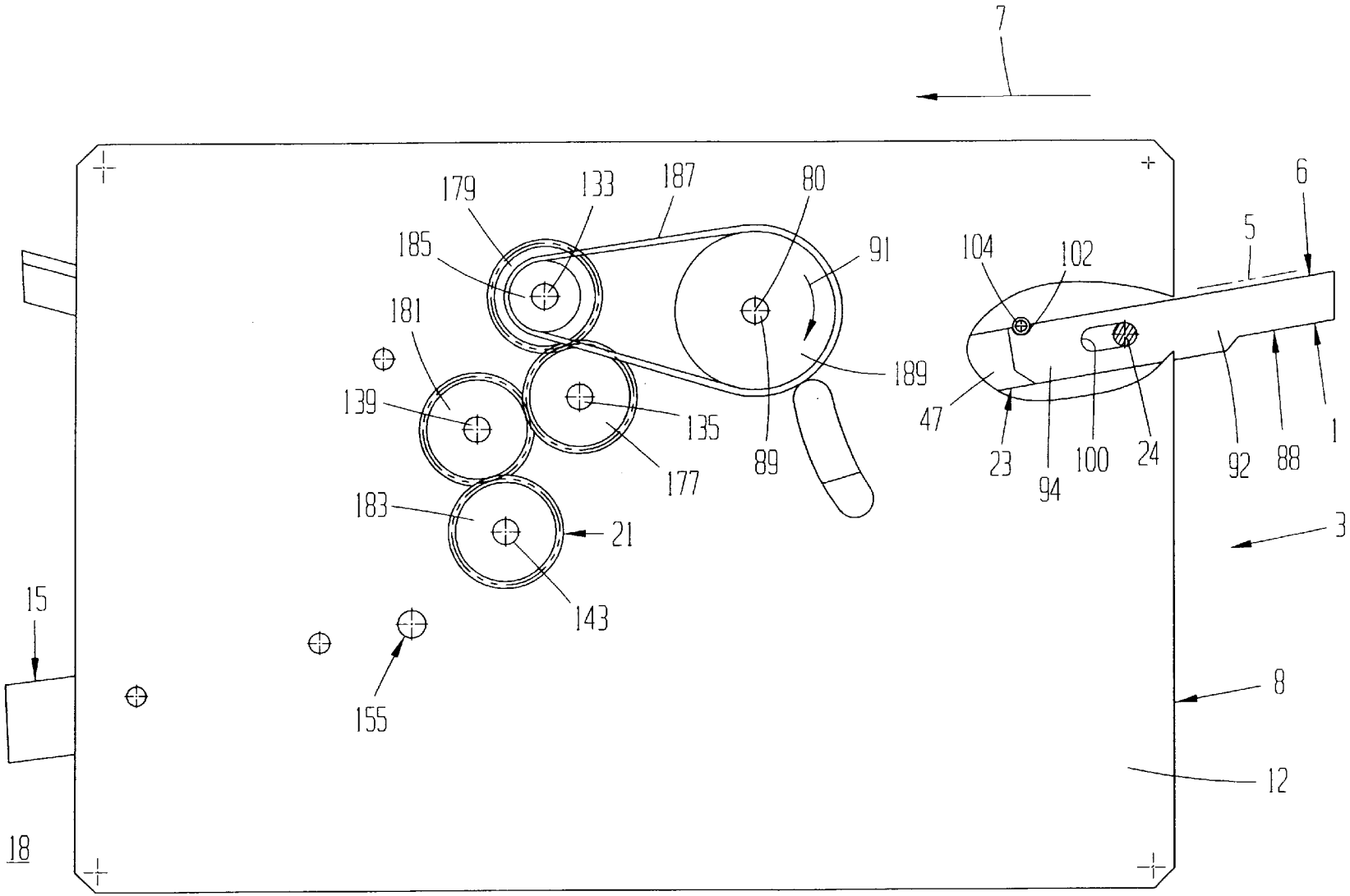
FIG. 1 is a broken front view of a paper folding machine that includes the present invention.
Figure 2:
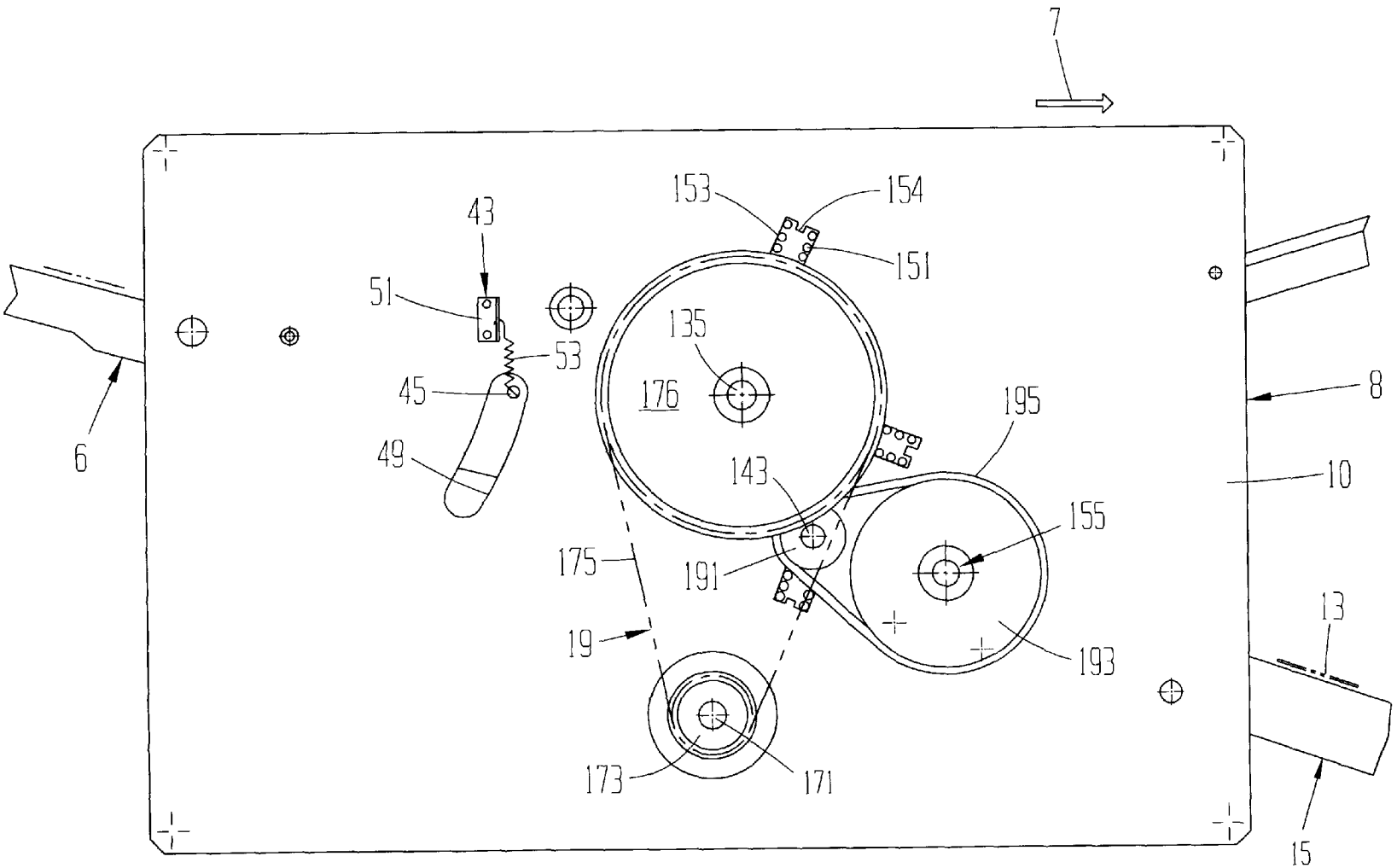
FIG. 2 is a back view of the paper folding machine of FIG. 1.
Figure 3:
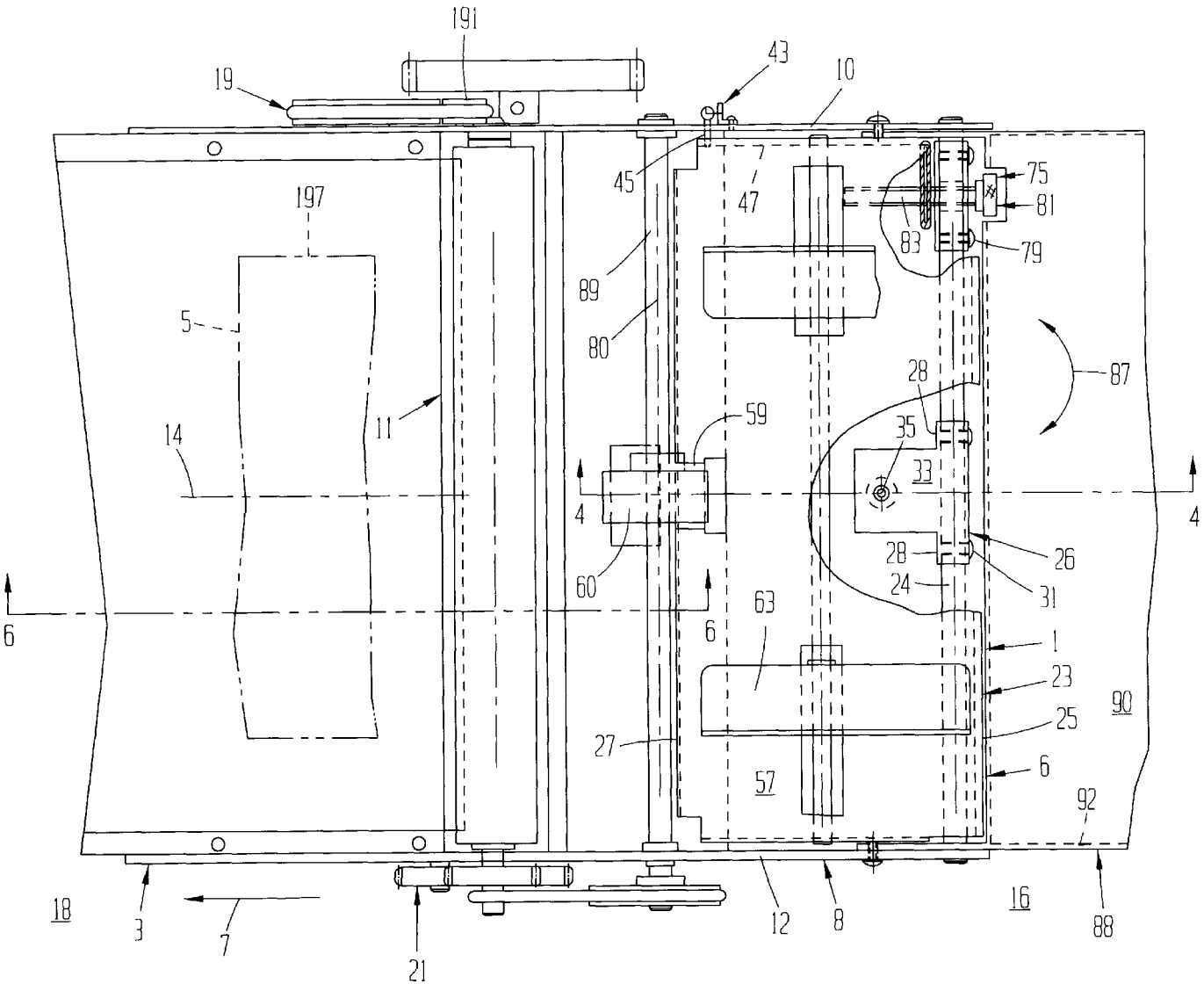
FIG. 3 is a top view of the paper folding machine.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring first to FIGS. 1–3 and 6, a simple and low cost paper feeder 1 is illustrated that includes the present invention. The paper feeder 1 is shown as an integral part of a paper folding machine 3. However, it will be understood that the invention is not limited to use with paper folding applications.

General

The illustrated paper folding machine 3 has a frame 8 that includes parallel side walls 10 and 12. The frame 8 defines a horizontal longitudinal centerline 14 substantially midway between the walls 10 and 12. The paper feeder 1 is at an upstream end 16 of the machine.

The paper feeder 1 includes a paper supply station 6 and a gate tip 9. A stack of paper sheets represented at reference numeral 5 is loaded at the paper supply station 6. The paper supply station cooperates with the gate tip 9 to propel the sheets 5, one at a time, in a downstream direction 7 to a folding mechanism 11. In the particular folding mechanism 11 shown, the sheets are folded into C-folded business forms. The completed forms, represented at reference numeral 13, are discharged from the folding mechanism onto a conveyor 15 at a downstream end 18 of the paper folding machine 3. The conveyor 15 propels the forms 13 in the downstream direction 7 for further processing. Power for operating the folding machine comes from an electric motor 17 operating through two drive trains 19 and 21.

Paper Supply Station

In the illustrated construction, the paper supply station 6 comprises a pickoff wheel 60 secured to a shaft 89 having a longitudinal axis of rotation 80. A pickoff wheel having 75 flat teeth around its circumference and made of a rubber material having a hardness of durometer 40A works very well. The drive systems 19 and 21, to be described shortly, rotate the shaft 89 in the direction of arrow 91.

The paper supply station 6 is further comprised of a tray 23 and a tray shaft 24. The ends of the tray shaft 24 are held loosely in the walls 10 and 12 of the machine frame 8.

Mounted to the tray shaft is a pivot bracket 26. The pivot bracket 26 has a pair of channels 28 that fit over and mount to the tray shaft by screws 31. A plate section 33 of the pivot bracket extends in the downstream direction 7 from the channels 28. There is a hole 39 through the plate section 33 substantially on the machine centerline 14. The bracket hole defines a bracket axis 36 that is generally perpendicular to the downstream direction 7. Also see FIG. 4.

The tray 23 has an upstream end 25 and a downstream end 27. On the tray upper surface 57 at the downstream end 27 is bonded a piece of cork 59. The tray upstream end 25 is supported on the pivot bracket 26. A stud 35 is welded to the tray. A collar 37 has a hub that fits in the hole 39 in the pivot bracket plate section 33. The tray stud 35 passes through a central hole in the collar 37. A nut 41 threaded on the stud secures the collar, pivot plate, and tray together. The tray is thus able to swing in the directions of arrows 62 within the machine frame 8 about the tray shaft 24.

The tray downstream end 27 is supported by a spring system 43. The spring system 43 is composed of a pin 45 in one of the side walls 47 of the tray 23. As shown, the pin 45 threads into a tray wall 47. The pin passes through an arcuate cutout 49 in the machine wall 10. A tray spring 53 has a first end hooked around the pin. A second end of the tray spring 53 is hooked around a clip 51 fastened to the frame wall 10. The clip 51 preferably has two or more vertically spaced notches. The tray spring second end can be hooked in a selected one of the clip notches. The tray spring biases the pin and thus the tray downstream end upwardly against the pickoff wheel 60. The cork piece 59 contacts the pickoff wheel at a first tangent point P1. The force with which the tray cork piece contacts the pickoff wheel can be varied by hooking the tray spring 53 in different notches in the clip 51.

The paper supply station 6 further comprises a pair of paper guides 61. The paper guides 61 have respective flanges 63 that rest on the tray upper surface 57. Tabs 65 under the paper guide flanges 63 have respective holes 64 that receive a long rod 67. The rod 67 has opposite ends that are held in the tray side walls 47.

Associated with each paper guide 61 is a leaf spring 69. Each leaf spring 69 has a flat leg 71 that bears against the underside of the paper guide flange 63. The leaf spring also has an arcuate section 73 that is compressed toward the flat leg 71 and clips over the rod 67. The restoring force of the leaf spring urges the paper guide upwardly away from the tray surface 57. The hole 64 in the paper guide bears against the rod 67. The friction between the rod 67 and the paper guide hole 64 prevents the paper guide from unintentionally sliding along the rod. However, a light downward manual force on the paper guide overcomes the restoring force of the leaf spring and enables the paper guide to be slid along the rod to suit different width paper sheets 5.

Skew Compensator

It is an important feature of the invention that the paper supply station 6 can be adjusted to assure that the paper sheets 5 are properly oriented as they are propelled in the downstream direction 7. Proper sheet orientation is achieved by a skew compensator 75. The skew compensator 75 is composed of a channel shaped side bracket 77 that fits over the tray shaft 24. The side bracket 77 is fixed to the tray shaft by screws 79. The side bracket supports the upstream end 25 of the tray 23 along with the pivot bracket 26.

A compensator screw 81 has a shank 83 that passes through clearance holes in legs 84 of the side bracket 77. The compensator screw shank 83 threads into a tapped hole in a flange 85 that is bent over from one of the tray side walls 47. A spacer 87 fits over the compensator screw shank between the legs 84 of the side bracket. By turning the compensator screw 81, the tray 23 rotates about the bracket axis 36 in the directions of arrows 87, FIG. 3.

An extension tray 88 is also part of the paper folding machine 3. The extension tray 88 has a flat central area 90 and side walls 92. The central area 90 terminates close to the upstream end 25 of the tray 23. A slot 100 in each side wall 92 receives the tray shaft 24. The extension tray side walls 92 have respective arms 94 that fit between the tray walls 47 and the machine frame walls 10 and 12. A notch 102 in each arm 94 engages a corresponding screw or the like 104 in each frame wall. The screws 104 and the tray shaft 24 cooperate to support the extension tray on the machine frame 8.

Gate Tip

To reliably propel one sheet 5 of paper at a time from the paper supply station 6 in the downstream direction 7, the paper feeder 1 further includes the gate tip 9. In the preferred embodiment, the gate tip comprises a ramp 95 that extends between the machine frame walls 10 and 12. The ramp 95 is formed with a first plate 96 and a second plate 98 that intersect at an angle of approximately 50 degrees. Tabs 97 on the ends of the plates 96 and 98 abut the frame walls; screws 99 attach the tabs 97 to the frame walls. The ramp plate 98 makes an angle of approximately 21 degrees with the downstream direction 7. The angular dimensions of the ramp are such that the first plate 96 is generally tangent to an arc through which the downstream end 27 of the tray 23 swings about the tray shaft 24. The first plate terminates in a ledge 103. There is a central opening 101 through the ramp under the pickoff wheel 60.

On the side of the ramp second plate 98 opposite the pickoff wheel 60 is a channel shaped riser 105. The riser 105 spans the central opening 101. A nut 107 is welded to a central leg 108 of the riser. The shank 106 of a singulator screw 109 threads through the nut 107 and through an aligned clearance hole in the riser center leg 108. Preferably, the longitudinal centerline 112 of the singulator screw shank 106 does not pass through the axis of rotation 80 of the pickoff wheel shaft 89. Rather, the singulator screw longitudinal centerline 112 passes in the downstream direction 7 of the axis of rotation of the shaft 89.

Pivotally connected to the ramp 95 under the central opening 101 is a singulator 110. In the preferred embodiment, the singulator 110 is comprised of a singulator bracket 111 to which is fastened a singulator mount 121. The singulator bracket 111 has a pair of tabs 113 and a plate section 115 between the tabs. The singulator bracket tabs 113 are pivotally connected to associated lugs 117 on the ramp by respective fasteners 119. The singulator mount 121 is fastened, as by screws 120, to the plate section 115 of the singulator bracket 111. The singulator mount 121 has an overhanging portion 123 that is aligned with the singulator screw 109. A singulator spring 125 is interposed between the ramp riser 105 and the singulator mount overhanging portion 123. As illustrated, the singulator spring 125 is placed over the singulator screw shank 106. The surface of the singulator mount overhanging portion opposite the singulator spring 125 is covered with a polymer pad 127. The singulator spring 125 biases the pad 127 into contact with the pickoff wheel 60 at a second tangent point P2. The tangent points P1 and P2 subtend an angle D about the pickoff wheel axis of rotation 80. The singulator screw 109 is adjusted to set a predetermined clearance C between the end 131 of the shank 106 and the singulator mount overhanging portion 123. (For clarity, the clearance C is shown greatly exaggerated.)

Folding Mechanism

Figure 6:
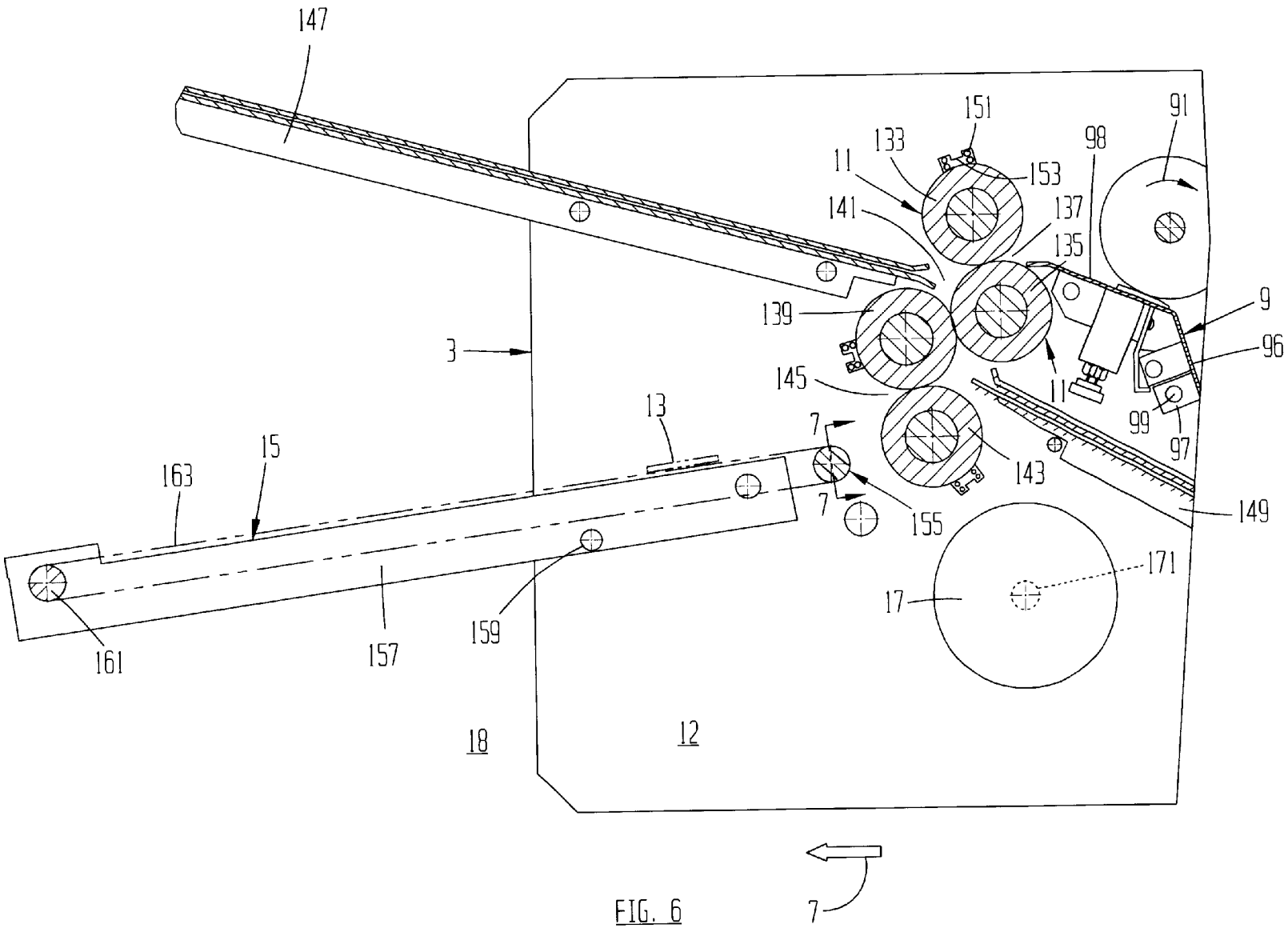
FIG. 6 is a cross-sectional view taken along line 6—6 of FIG. 3.

Looking especially at FIG. 6, the folding mechanism 11 is comprised of a first roller 133 and a second roller 135 that cooperate to make a first nip 137. The folding mechanism further has a third roller 139 that cooperates with the second roller 135 to make a second nip 141, and a fourth roller 143 that cooperates with the third roller 139 to make a third nip 145. There is a first fold chute 147 at the output side of the first nip 137, and a second fold chute 149 at the output side of the second nip 141.

The first roller 133 is urged toward the second roller 135 by springs 151 in the machine frame walls 10 and 12. For that purpose, the frame walls have cutouts 153 each with a center tab 154. A spring 151 fits in each cutout 153 between the center tab 154 and a bushing, not shown, in the frame wall in which the associated roller rotates. In a similar manner, the third roller 139 is urged against the second roller 135, and the fourth roller 143 is urged against the third roller 139.

Conveyor

The conveyor 15 has a drive shaft 155 near the output side of the fourth nip 145. A conveyor deck 157 is joined to the frame walls 10 and 12 by fasteners 159. A driven shaft 161 is at the distal end of the conveyor deck 157. Two or more belts 163 are trained around the shafts 155 and 161.

Figure 7:
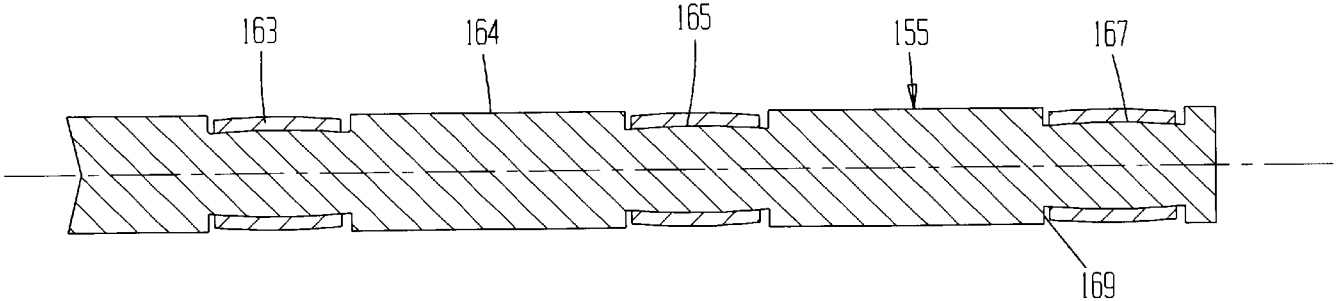
FIG. 7 is a partial cross-sectional view on an enlarged scale taken along line 7—7 of FIG. 6.

Looking at FIG. 7, the conveyor drive shaft 155 has an outer diameter 164 with a number of circumferential grooves 165. The surfaces of the grooves 165 are not cylindrical in shape. Rather, they have a crowned shape, such that the shaft diameter at the center 167 of each groove is larger than the diameter at the ends 169 of the groove. We have found that a radius of approximately 2.66 inches for the crowned surface of each groove is satisfactory. The driven shaft 161 can be a constant diameter cylinder for its entire length.

The belts 163 are trained over the conveyor drive shaft 155 with one belt in each groove 165. The crowned surfaces of the grooves greatly aid in keeping the belts at the proper spacing and alignment on the conveyor driven shaft 161. Accordingly, no grooves are necessary in the conveyor driven shaft.

Drive System

To provide motion to the various components of the paper supply station 6, folding mechanism 11, and conveyor 15, a conventionally controlled electric motor 17 is incorporated into the paper folding machine 3, FIG. 6. The motor shaft 171 protrudes through the frame wall 10, FIG. 2. The drive train 19 transmits power from the motor by means of a timing pulley 173 on the motor shaft 171. A timing belt 175 is trained over the pulley 173 and also over a larger timing pulley 176 on the second folding mechanism roller 135.

In the drive train 21, a gear 177 on the roller 135 transmits power to mating gears 179, 181, 183 on the rollers 133, 139, 143, respectively, FIG. 1. A pulley 185 on the shaft 133 has a belt or similar drive member 187 trained over it. The shaft 89 has a larger pulley 189 over which is trained the belt 187.

The drive train 19 also has a pulley 191 on the folder mechanism roller 143 on the side of the machine frame 8 opposite the gear 183. The pulley 191 drives the conveyor drive shaft 155 by means of a pulley 193 on the conveyor drive shaft and a connecting belt 195. It is thus seen that operating the motor 17 produces rotational motion in the pickoff wheel 60; rollers 133, 135, 139, 143; and conveyor drive shaft 155.

Operation

To use the paper folding machine 3, the gate tip 9 is adjusted to suit the thickness of the particular paper sheets 5 loaded at the paper supply station 6. Specifically, the singulator screw 109 is adjusted to set the clearance C to be equal to at least the thickness of a sheet. If desired, the clearance can be set to be greater than the thickness of one sheet but less than the thickness of two sheets. The location of the compensator screw in the machine makes the adjustment easy to do. The fact that the singulator screw centerline 112 does not intersect the pickoff wheel axis of rotation 80 aids in properly setting the clearance C. The singulator spring 125 urges the singulator polymer pad 127 against the pickoff wheel 60 at the second tangent point P2.

Figure 4:
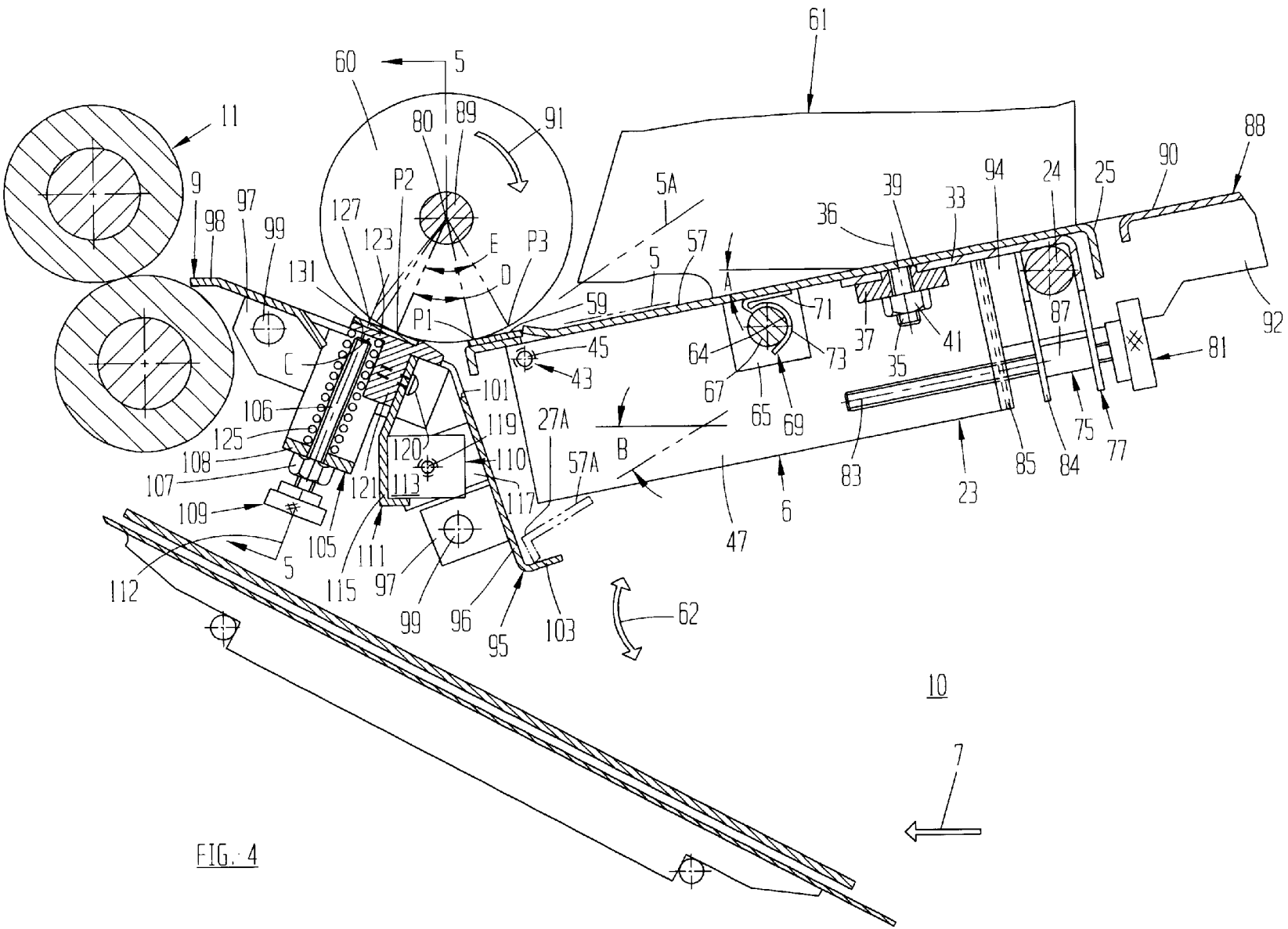
FIG. 4 is a cross-sectional view on an enlarged scale taken along line 4—4 of FIG. 3.
Figure 5:
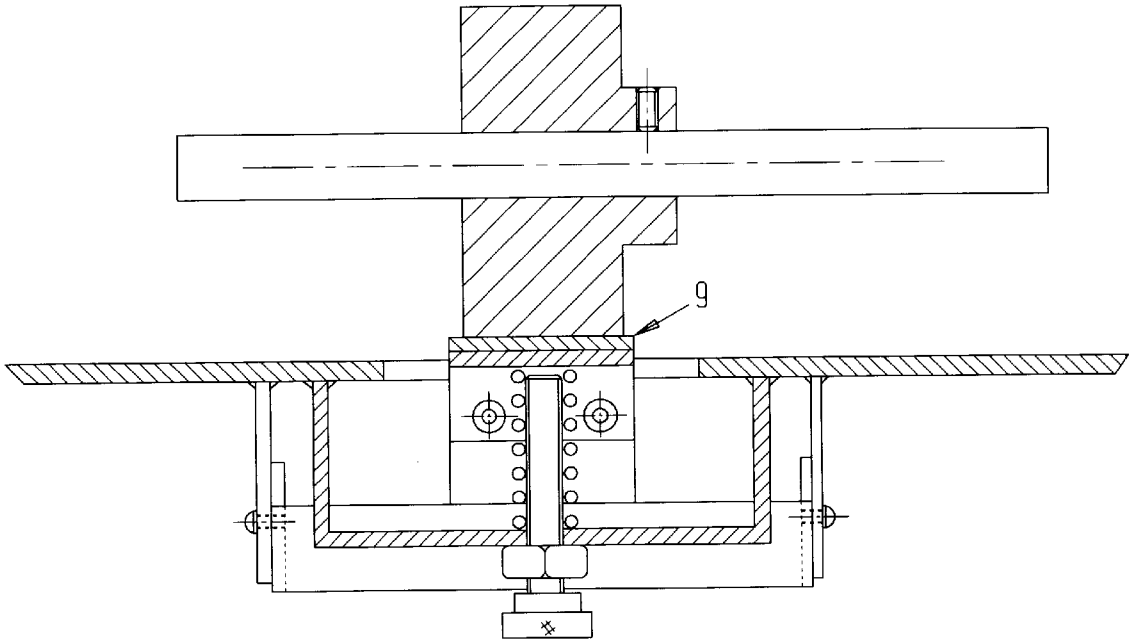
FIG. 5 is a cross-sectional view taken along line 5—5 of FIG. 4.

In FIG. 4, the paper supply station 6 is shown with no sheets loaded onto the tray 23. In that situation, the spring system 43 biases the cork pad 59 on the tray into direct contact with the pickoff wheel 60 at the first tangent point P1. The plane of the tray upper surface 57, and thus of a single imaginary sheet 5 of paper on it, makes a first angle A with the downstream direction 7. The tangent points P1 and P2 subtend the angle D about the axis of rotation 80 of the pickoff wheel shaft 89. The extension tray central area 90 is then generally coplanar with the tray upper surface.

As sheets 5 of paper are loaded at the paper supply station 6, the tray 23 swings downwardly against the force of the spring system 43. Maximum swinging is attained when the downstream end 27 of the tray contacts the ledge 103 of the gate tip ramp 95. At that point, the downstream end of the tray is as shown at reference numeral 27A in FIG. 4. The upper surface 57A of the tray then makes an angle B with the downstream direction 7. Thus, the tray swings through a swing angle, which is the angle between the angles A and B, as it is fully loaded with sheets. The topmost sheet 5A also makes the angle B with the downstream direction. It will be recognized that the topmost sheet 5A contacts the pickoff wheel 60 at a third tangent point P3 that is in the upstream direction from the first tangent point P1. The tangent points P3 and P2 subtend an angle E about the pickoff wheel axis of rotation 80 that is greater than the angle D. We have found that an angle D of approximately 35 degrees is satisfactory. In one embodiment of the invention, the angle E for the capacity of the paper supply station of approximately 250 sheets 5 is approximately 52 degrees.

A beneficial feature of the invention is that the first plate 96 of the ramp 95 guides the leading edges of the paper sheets 5 loaded on the tray 23. That is because the ramp plate 96 is generally tangent to the arc through which the tray downstream end 27, 27A swings between the angles A and B. The sheets therefore do not have to be fanned or reverse fanned by hand as is the case with many prior paper feeders. Rather, the sheets are quickly and efficiently loaded merely by placing them on the tray and against the ramp plate 96. The tray spring 53 is hooked in the proper notch of the clip 51 to give the desired force of the sheets against the pickoff wheel 60 at the third tangent point P3.

It is a feature of the invention that it can properly feed the paper sheets 5, 5A for any quantity loaded at the paper supply station 6 up to the capacity of the paper folding machine 3. The sheets can make any angle between the angles A and B and still be properly propelled downstream. The topmost sheet contacts the pickoff wheel 60 at a tangent point that continuously changes between the first tangent point P1 and the third tangent point P3 as the number of sheets at the paper supply station decreases. Simultaneously, the angle subtended about the pickoff wheel axis of rotation 80 between the fixed second tangent point P2 and the moving tangent point constantly decreases from angle E to angle D.

For any number of sheets 5 on the tray 23, the friction between the rotating pickoff wheel 60 and the topmost sheet successfully causes the pickoff wheel to propel the sheet in the downstream direction 7. The friction between the topmost sheet and the next underlying sheet is less than the friction between the pickoff wheel and the topmost sheet. Therefore, there is but a minimal tendency for the next underlying and subsequent lower sheets of the stack to be propelled downstream.

The leading edge of the paper sheet 5 strikes the polymer pad 127 of the gate tip 9 slightly upstream of the nip between the pickoff wheel 60 and the polymer pad. The pushing force on the sheet produced by the pickoff wheel 60 at the first tangent point propels the sheet leading edge into the nip between the pickoff wheel and the polymer pad at the second tangent point P2. The singulator bracket 111 with the singulator mount 121 pivots away from the pickoff wheel against the force of the singulator spring 125 through at least a portion of the clearance C. At that moment, the sheet is propelled by the pickoff wheel at both tangent points P3 and P2. If the next underlying sheet should be propelled from the stack with the topmost sheet past the downstream end 25 of the tray 23, the leading edge of the next sheet will also strike the gate tip polymer pad 127. Although remote, there is a possibility that the next sheet would try to enter the nip between the pickoff wheel 60 and the polymer pad simultaneously with the topmost sheet. For that to occur, the singulator 110 would have to pivot away from the pickoff wheel to produce a clearance equal to the thickness of the two sheets. However, the positive stop of the singulator mount overhanging portion 123 against the singulator screw end 131 after the clearance C has been taken up prevents the next underlying sheet from passing through the nip. Accordingly, the gate tip reliably assures that only one sheet at a time is propelled past the gate tip.

The singulator screw 109 of the gate tip 9 accommodates a number of paper sheet thicknesses with a single setting. For example, if sheets 5 of a first batch have a thickness of 0.007 inches, the gate tip will function properly to prevent double feeding with a clearance C that is within the range of between approximately 0.007 inches and 0.013 inches. If the clearance C is set toward the low end of that range, sheets thinner than the first batch can be processed without readjusting the singulator screw. If the clearance C is initially set at the high end of the range that suits the first batch of sheets, thicker sheets can be handled without readjusting the singulator screw.

From the gate tip 9, the paper sheet 5 is propelled in the downstream direction 7 to the first nip 137 of the folding mechanism 11. The rollers 133 and 135 of the first nip propel the sheet leading edge into the first fold chute 147. A stop, not illustrated in the drawings but well known to those skilled in the art, in the first fold chute is set to stop the sheet such that a first fold is produced in the sheet. The fold is caught in the second nip 141. The rollers 135 and 139 of the second nip propel the sheet folded edge into the second fold chute 149. Another stop on the second fold chute causes a second fold to be produced in the sheet. The sheet at the second fold enters the third nip 145, from which it is discharged as a completed form 13 onto the conveyor 15. The conveyor belts 163 propel the completed form in the downstream direction for further processing.

If the folds produced in the paper sheets 5 are not perfectly perpendicular to the edges 197 of the sheets (FIG. 3), the skew compensator 75 is adjusted. The compensator screw 81 is turned to rotate the tray 23 about the bracket axis 36. The tray can be rotated as little or as much as necessary to properly orient the sheets.

Modified Embodiment

In a modified embodiment, an alternate pickoff wheel generally similar to the pickoff wheel 60 described above is used, but the alternate pickoff wheel has a hardness less than durometer 40A. The singulator screw 109 is adjusted to set the clearance C to be slightly less than the thickness of one paper sheet 5. The sheets 5 are loaded at the paper supply station 6 and a topmost sheet is propelled in the downstream direction 7 as described previously. The relatively soft material of the alternate pickoff wheel enables it to compress to allow the topmost sheet to pass through the nip between the pickoff wheel and the singulator pad 127. However, if a second sheet tends to enter the nip, the alternate pickoff wheel does not compress enough to allow the second sheet to pass through the nip with the topmost sheet. As a result, the modified embodiment of the invention reliably propels one sheet at a time in the downstream direction.

In summary, the results and advantages of folded paper forms can now be more fully realized. The paper folding machine 3 provides both reliable feeding and folding of individual paper sheets 5 into completed forms as well as the ability to compensate for misorientation of the sheets. This desirable result comes from using the combined functions of the gate tip 9 and the skew adjustment 75. The gate tip singulator screw 109 can be set at a predetermined clearance C with the singulator 110 to accommodate a relatively wide range of thicknesses of the sheets without requiring additional adjustment. On the other hand, when adjustment is required, the singulator screw is conveniently accessible for quick and easy adjustment. The gate tip and paper supply station 6 are so constructed and located relative to each other that they coact to properly feed a stack of paper ranging from a single sheet up to the rated machine capacity. The skew compensator assures perfect folds in the sheets by feeding them with their side edges parallel to the downstream direction 7 of sheet travel. Any misorientation of the sheets is easily corrected by minor adjustments to the compensator screw 81. The crowned grooves 165 of the conveyor drive shaft 155 assure proper tracking of the belts 163 while using a cylindrical driven shaft 161.

It will also be recognized that in addition the superior performance of the paper folding machine 3, its construction is such as to significantly reduce the cost of feeding and folding paper sheets 5 as compared with traditional folders. Also, since the machine is constructed of a simple design and with rugged components, it gives long service life with minimum maintenance.

Thus, it is apparent that there has been provided, in accordance with the invention, a paper folding machine with a paper feeder that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction; and c. a gate tip comprising:
   i. a singulator pivotable toward and away from the pickoff wheel;
   ii. a singulator spring that biases the singulator against the pickoff wheel; and
   iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw.

2. The apparatus of claim 1 wherein:

a. the singulator screw does not pivot with the singulator; and b. the singulator screw shank defines a longitudinal centerline that does not intersect the pickoff wheel axis of rotation.

3. The apparatus of claim 1 wherein the predetermined clearance is less than the thickness of one paper sheet.

4. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction; and c. a gate tip comprising:
   i. a singulator pivotable toward and away from the pickoff wheel;
   ii. a singulator spring that biases the singulator against the pickoff wheel; and
   iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw, wherein:
      the gate tip further comprises a ramp having an opening therethrough proximate the pickoff wheel; and
      the singulator comprises a singulator bracket pivotally connected to the ramp, and a singulator mount generally within the ramp opening and fastened to the singulator bracket.

5. The apparatus of claim 4 wherein the singulator screw is threaded into the ramp.

6. The apparatus of claim 4 wherein:

a. the ramp comprises a channel shaped riser that spans the ramp opening; and b. the singulator screw is threaded into the ramp riser.

7. The apparatus of claim 6 wherein the singulator spring is interposed between the ramp riser and the singulator mount.

8. The apparatus of claim 4 wherein the singulator mount has an overhanging portion, and wherein the singulator spring contacts the singulator mount overhanging portion.

9. The apparatus of claim 4 wherein the ramp comprises a first plate that guides the leading edges of the paper sheets loaded on the means for loading the stack of sheets, so that the sheets require no fanning or reverse fanning when they are loaded.

10. The apparatus of claim 9 wherein:

a. the ramp first plate comprises a ledge;

b. the means for loading the stack of paper sheets comprises a tray having a downstream end proximate the pickoff wheel and an upstream end and defining an upper surface, the stack of sheets being loadable on the tray upper surface; and c. the tray downstream end rests on the ramp ledge when a maximum number of paper sheets is loaded on the tray.

11. The apparatus of claim 10 wherein:

a. the topmost paper sheet of the stack contacts the pickoff wheel at a first tangent point when only one sheet is stacked on the tray;

b. the singulator is biased to contact the pickoff wheel at a second tangent point;

c. the topmost paper sheet of the stack contacts the pickoff wheel at a third tangent point when the stack of sheets has sufficient sheets such that the tray downstream end rests on the ramp ledge;

d. the first and second tangent points subtend an angle of approximately 35 degrees about the pickoff wheel axis of rotation; and e. the third and second tangent points subtend an angle of approximately 52 degrees about the pickoff wheel axis of rotation.

12. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction; and c. a gate tip comprising:
   i. a singulator pivotable toward and away from the pickoff wheel;
   ii. a singulator spring that biases the singulator against the pickoff wheel; and
   iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw, wherein the singulator spring is placed over the singulator screw shank.

13. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction; and c. a gate tip comprising:
   i. a singulator pivotable toward and away from the pickoff wheel;
   ii. a singulator spring that biases the singulator against the pickoff wheel; and
   iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw, wherein the singulator screw shank defines a longitudinal centerline that does not intersect the pickoff wheel axis of rotation, and wherein the predetermined clearance between the end of the singulator screw shank and the singulator is between the end of the singulator screw shank and the singulator mount overhanging portion.

14. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction; and c. a gate tip comprising:

i. a singulator pivotable toward and away from the pickoff wheel;

ii. a singulator spring that biases the singulator against the pickoff wheel; and iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw, wherein the predetermined clearance is greater than the thickness of one paper sheet and less than the thickness of two paper sheets.

15. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction, wherein the means for loading the stack of paper sheets comprises:

i. a tray having a downstream end proximate the pickoff wheel and an upstream end swingable through a tray swing angle about a tray shaft and defining an upper surface, the stack of paper sheets being loadable on the tray upper surface; and ii. means for biasing the tray downstream end such that the topmost paper sheet of the stack is biased against the pickoff wheel at a first tangent point; and c. a gate tip comprising:

i. a singulator pivotable toward and away from the pickoff wheel, wherein the singulator contacts the pickoff wheel at a second tangent point, and wherein the first and second tangent points subtend an angle of approximately 35 degrees between the first and second tangent points when one paper sheet is loaded on the tray;

ii. a singulator spring that biases the singulator against the pickoff wheel; and iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw.

16. The apparatus of claim 15 wherein the first and second tangent points subtend an angle of approximately 52 degrees when a large number of paper sheets are loaded on the tray.

17. The apparatus of claim 15 wherein:

a. The gate tip further comprises a ramp having a first plate that is generally tangent to the tray downstream end as the tray swings through the tray swing angle, and a second plate joined to the first plate, the second plate defining an opening therethrough; and b. The singulator screw passes through the opening in the second plate.

18. Apparatus for propelling paper sheets each having a predetermined thickness and a leading edge one at a time in a downstream direction comprising:

a. means for loading a stack of the paper sheets;

b. a pickoff wheel in contact with a topmost paper sheet loaded on the means for loading the stack of sheets, the pickoff wheel rotating about an axis of rotation to propel the topmost sheet in the downstream direction, wherein the means for loading the stack of paper sheets comprises:

i. a tray having a downstream end proximate the pickoff wheel, and an upstream end, the stack of paper sheets being loadable on the tray;

ii. means for biasing the tray downstream end such that the topmost paper sheet of the stack thereof loaded on the tray is biased against the pickoff wheel; and iii. means for compensating misoriented paper sheets propelled in the downstream direction, wherein the means for compensating misoriented paper sheets comprises:

a tray shaft proximate the tray upstream end;

a pivot bracket mounted to the tray shaft and supporting the tray near the upstream end thereof for rotating about a bracket axis that is generally perpendicular to the downstream direction;

a side bracket fixed to the tray shaft; and a compensator screw threaded between the side bracket and the tray; and c. a gate tip comprising:

i. a singulator pivotable toward and away from the pickoff wheel;

ii. a singulator spring that biases the singulator against the pickoff wheel; and iii. a singulator screw having a shank with an end at a predetermined clearance from the singulator, the topmost sheet propelled by the pickoff wheel entering a nip between the pickoff wheel and the singulator and pivoting the singulator away from the pickoff wheel to take up at least part of the clearance between the singulator and the singulator screw, so that turning the compensator screw causes the tray to rotate about the bracket axis.

19. In apparatus that propels sheets of paper in a downstream direction comprising a frame with a wall, and a tray that loads a stack of the sheets, a skew compensator that compensates for misorientation of the sheets comprising:

a. a tray shaft held in the frame;

b. a first bracket mounted to the tray shaft and defining a bracket axis that is generally perpendicular to the downstream direction, the first bracket supporting the tray; and c. means for rotating the tray about the bracket axis to thereby change the orientation of the sheets loaded on the tray relative to the downstream direction.

20. The apparatus of claim 19 wherein the means for rotating the tray comprises:

a. a second bracket fixed to the shaft; and b. a screw threaded between the second bracket and the tray, so that adjusting the screw causes the tray to rotate about the bracket axis.

21. The apparatus of claim 19 wherein the tray has upstream and downstream ends, and wherein the pivot bracket supports the tray near the tray upstream end.

22. The apparatus of claim 21 wherein:

a. the tray shaft is swingable within the frame; and b. the tray comprises:

i. a pin connected to the tray proximate the downstream end thereof and passing through the frame wall;

ii. a clip on the frame wall on an opposite side thereof as the tray; and iii. a spring between the pin and the clip that biases the tray upstream and upwardly against the weight of the stack of sheets loaded on the tray.

* * * * *